US005275380A

United States Patent [19]

Barsby

[11] Patent Number: 5,275,380

[45] Date of Patent: Jan. 4, 1994

[54] VANITY SLAT APPARATUS

[76] Inventor: James B. Barsby, 13116 La Jolla Cir., La Mirada, Calif. 90638

[21] Appl. No.: 995,755

[22] Filed: Dec. 23, 1992

[51] Int. Cl.[5] ..... E04H 17/00

[52] U.S. Cl. ..... 256/34; 256/32

[58] Field of Search ..... 256/34, 32, 22, 21

[56] References Cited

U.S. PATENT DOCUMENTS

| | | | |
|---|---|---|---|
| 155,157 | 9/1874 | Holt | 256/34 |
| 338,818 | 3/1886 | Baird | 256/34 |
| 480,101 | 8/1892 | Ingram | 256/34 |
| 2,760,759 | 8/1956 | Rice . | |
| 2,802,645 | 8/1957 | Rice . | |
| 3,355,150 | 11/1967 | Taylor | 256/34 |
| 3,356,343 | 12/1967 | Taylor | 256/34 |
| 3,572,640 | 3/1971 | Vecchiarelli | 256/34 |
| 3,712,590 | 1/1973 | Tochner et al. | 256/34 |
| 3,913,889 | 10/1975 | Nugent et al. | 256/12.5 |
| 3,958,794 | 5/1976 | Suprunuk | 256/34 |
| 4,085,954 | 4/1978 | Thompson | 256/34 |
| 4,512,556 | 4/1985 | Meglino | 256/34 |
| 4,723,761 | 2/1988 | Cluff | 256/34 |
| 4,836,505 | 6/1989 | Meglino | 256/34 |
| 4,995,591 | 2/1991 | Humphrey et al. | 256/34 |
| 5,007,619 | 4/1991 | Sibeni | 256/34 |
| 5,056,761 | 10/1991 | Meglino et al. | 256/34 |

FOREIGN PATENT DOCUMENTS

| | | | |
|---|---|---|---|
| 675774 | 12/1963 | Canada | 256/34 |

*Primary Examiner*—Randolph A. Reese
*Assistant Examiner*—Anthony Knight
*Attorney, Agent, or Firm*—Fulwider Patton Lee & Utecht

[57] ABSTRACT

An improved slat to be inserted through and attached to a chain link fence to provide privacy, security, and protection from particulate matter and sound. Slats of this improved type are positioned vertically, side-by-side along the fence. The slat is formed of longitudinal ribs giving it a corrugated nature. This gives strength and dimension to the slat. Raised retaining tabs are formed on a slat rib on one side of the slat. The retaining tabs are formed of unitary raises. A length of a chain link fence interlocks into a groove formed between the two unitary raises to secure the slat to the fence. In a preferred embodiment, the vanity slat apparatus is formed of PVC.

8 Claims, 1 Drawing Sheet

FIG. 1
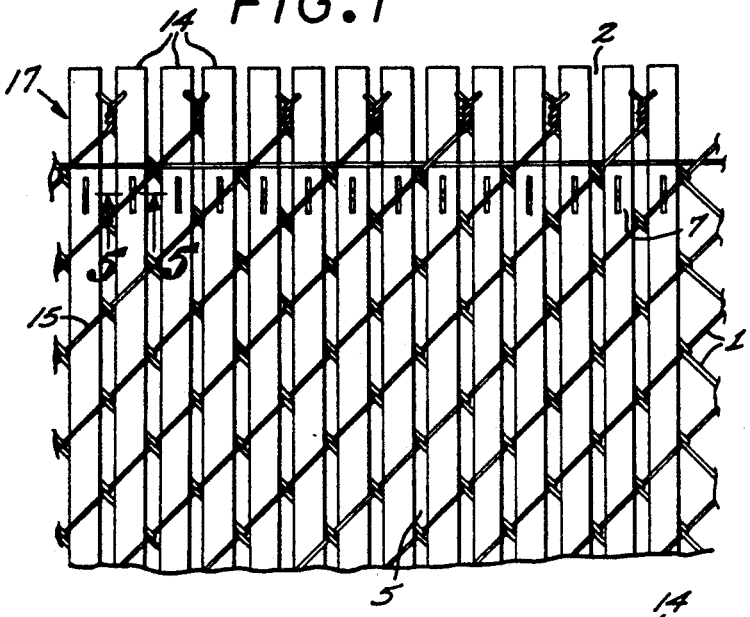
FIG. 2
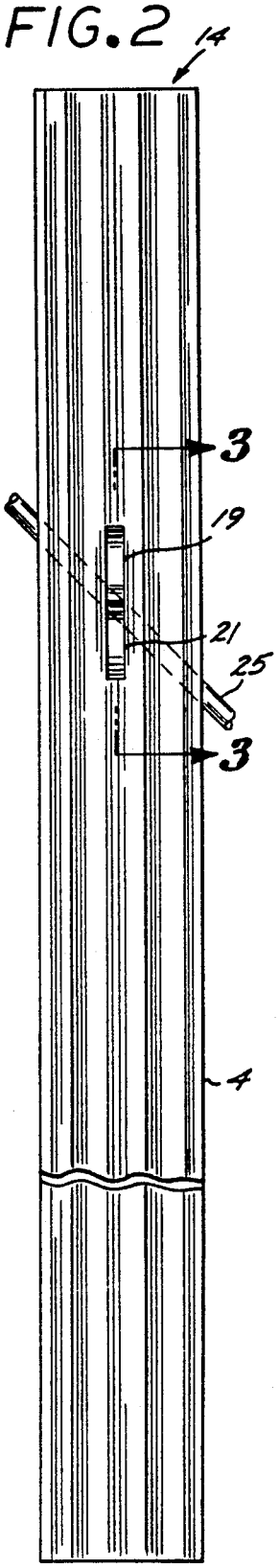
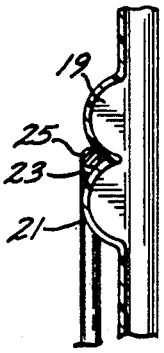
FIG. 3
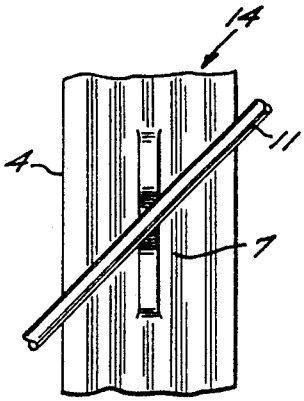
FIG. 4
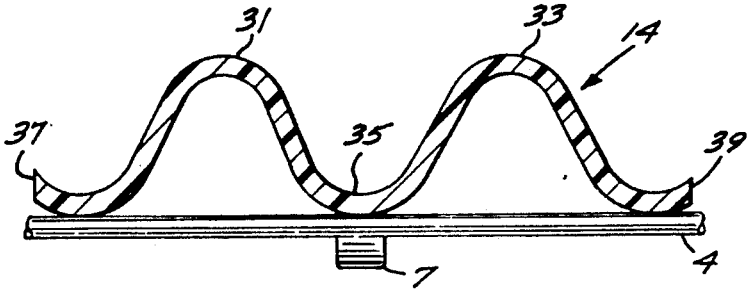
FIG. 5

VANITY SLAT APPARATUS

BACKGROUND OF THE INVENTION

1. Field of the Invention

The present invention relates, generally, to privacy devices for chain link fences and more particularly to a better vanity slat apparatus interweavable through a chain link fence.

2. Description of the Prior Art

It is common for owners or occupants of residential and commercial property to surround their property with a chain link fence to prevent or restrict the passage of people or animals across property lines. Chain link fences provide a secure enclosure of low cost and good durability. Such fences are formed of flattened helical wire strands interlocked to form a wide mesh wire fabric supported at spaced intervals by upright tubular members. Chain link fencing has certain disadvantages, however.

The appearance of chain link fencing is strictly utilitarian, and not necessarily attractive. Further, chain link fencing provides little privacy for the occupants of the fenced property, nor does it prevent the occupiers of the property and fails to block the view of adjacent views, such as streets or alleys. For certain applications, the unobstructed visibility through a chain link fence is distinctly disadvantageous. When privacy is desired, or where a wind break is needed, a chain link fence by itself is unsatisfactory.

Accordingly, chain link fences may be provided with slats to cover the openings in the fence and obstruct visibility. To improve the appearance of chain link fencing, and to provide a degree of privacy, it is a common practice to insert opaque slats between the links of the chain link fencing, usually in vertical orientation. Optimally such slats should be attractive, low in cost, durable, and should not rattle or become loose because of vibrations or wind.

Such slats have a tendency to shift longitudinally after being inserted in the wire fabric of the chain link fence so as to become disarranged and uneven. Dislodged slats can detract from the aesthetics. A successful slat must be securely attached to the fence and somehow restrained from falling through the fencing.

Over the years, arrangements have been devised to restrain the slats in position, including the use of an upwardly-concave channel inserted horizontally through the lower most links of the fence with the lower end of the slats resting in the channel. Restraining members have also been utilized to cap the tops of side-by-side vertical slats.

Because the fabrication of a chain link fence typically provide wire runs forming diamond shaped openings, most prior art slats comprise elongate strips which seat within these openings. The slats can be positioned either vertically or diagonally at a forty-five degree angle to the horizontal. The slats are often clipped to the chain itself by fasteners or hooking tabs on the slats. The slats can also be connected to each other by clips or snaps.

Slat sections can be accordion-shaped to provide expandability for different widths of chain link grid. U.S. Pat. No. 4,723,761 shows such an arrangement. In that device, such slats are formed with bores on their outer periphery to receive U-shaped clips to connect one slat to another. The slats are inserted and intertwined through the mesh gridwork.

Skilled artisans and consumers have found that using tabs or clips to hook the slats to each other or to the fence strands is inconvenient. Thus, different and additional ways to attach slat devices to fences and prevent their removal, without snaps and fasteners, have been suggested.

Various retaining lock devices for chain link fence slats have been designed. Some arrangements incorporate an open channel which is inserted horizontally through the lower most or uppermost course of links of the fence. A locking arrangement is provided to lock such slats to the channel to prevent their removal. The slats may be formed on one end with a bevel and may include a locking notch for locking a locking channel in position. U.S. Pat. No. 4,995,591 shows such an arrangement. While satisfactory for their intended purposes, devices of this type suffer the shortcoming that separate locking channels are required, the attachment of which require a certain degree of dexterity.

U.S. Pat. No. 5,007,619 shows a similar chain link fence slat arrangement including a top horizontal channel, a bottom horizontal channel, and slats formed with lock tab bottoms that can be locked into the bottom horizontal channel. Devices of this type also require careful alignment of the top and bottom ends of the slats in the locking channels.

Another common means of attaching the vertical slats to the chain link fence is to manufacture each vertical slat with an aperture to receive a horizontal member therethrough. The horizontal member can be inserted through the apertures on the series of vertical slats, supporting the slats and restricting removal thereof. A device of this type is shown in U.S. Pat. No. 4,512,556.

U.S. Pat. No. 5,056,761 shows a similar construction in which the slats are angled at forty-five degrees. Each of the forty-five degree positioned slats is formed with a retaining hole in it. A horizontal retaining slat is inserted through the series of retaining holes of the slats to keep them stable and in place.

A mesh fence for snow or particle drifts is shown in U.S. Pat. No. 3,913,889. Vertical slats are stapled transverse to the length of the mesh fence across the mesh fence. In another embodiment, a collapsible fence is described with the slat members connected to each other by snap fasteners.

One of the most common arrangements employed in the past to restrain slats in a fence was a strip member extending across the top of the slats, connected to each slat, to retain the slats in the fence as shown in U.S. Pat. No. 4,836,505.

U.S. Pat. No. 2,760,759 describes a chain link fence, slats, possibly of wood, woven through the fence, and a lock strip at the bottom on which the slats rest or to which the slats are attached.

U.S. Pat. No. 4,085,954 shows vertical slats in a chain link fence, an upper horizontal channel, and a lower horizontal retaining member channel. The lower channel is provided at the bottom of the fence, holding the slats in place. The slats may be plastic.

The slat used with the chain link fence can be flexible with a flattened cross-section. Such slats are manufactured of polyethylene, a similar plastic, wood, or metal. They are offered by manufacturers in various colors.

U.S. Pat. No. 3,712,590 shows that the slat depth can be varied to keep the slats from falling out. A slat will then fit snugly in the fence with its portions flush to each side and will not rattle.

As described above, slats for a chain link fence have been designed in an accordion-like shape to expand to fit the fence mesh. See U.S. Pat. No. 4,723,761. However, devices of this type are relatively expensive to manufacture and require some degree of dexterity to install.

There is a need for more privacy and protection than that provided by a mere chain link fence. Many slat devices have been suggested to improve chain link fences for vanity sake, to protect against particulate matter in the air, sound, temperature, and wind. Slats inserted in a chain link fence are subject to displacement either by accident or because of vandalism. This creates an unsightly appearance and destroys the privacy of the occupiers of the property. Therefore there is a need for the slats to be securely attached to the fence.

There is a need for inexpensive, lightweight, sturdy, attractive slats which are convenient to install and which incorporate a retainer operative upon engagement with the fence to hold the slats in place.

Wooden slats deteriorate with continued exposure to the elements, and their attractiveness can only be restored by removing them from the fence for restraining or repainting. This periodic restoration is time-consuming and costly. An improved slat composition is necessary.

SUMMARY OF THE INVENTION

Therefore, it is an object of the present invention to provide vanity slats for a chain link fence which incorporate as an integral part retainers to attach the slats to the fence.

It is another object of the present invention to provide a better construction of the slats. The slats of the present invention are corrugated and ribbed in structure to enhance their strength and, additionally, are springy in transverse cross section so they fit securely in the chain link fence mesh webbing. Retaining bosses are formed on the slats to securely interlock with the links of a chain link fence. The ribbed nature of the slat and the retaining bosses formed thereon combine to successfully secure the slats to the fence and to eliminate rattling. This improved construction makes the vanity slat strong and durable.

It is still another object of the present invention to provide a better composition for chain link fence vanity slats. In an embodiment of the present invention, the slats are formed of PVC, which is lightweight and easy to manufacture. The use of PVC in the composition of the slats also enables the slats to be manufactured in various colors. This improved composition is trouble free, easily manipulable, and reliable in use.

Other features and advantages of the invention will become apparent from the following detailed description, taken in conjunction with the accompanying drawings, which illustrate, by way of example, the features of the invention.

BRIEF DESCRIPTION OF THE DRAWINGS

FIG. 1 is a front view of a conventional chain link fence through which improved vanity slats of the present invention have been inserted and attached;

FIG. 2 is an enlarged broken front view of an individual vanity slat incorporated in the fence shown in FIG. 1;

FIG. 3 is a vertical sectional view taken along the line 3—3 of FIG. 2;

FIG. 4 is a front view of the slat shown in FIG. 3; and

FIG. 5 is a transverse sectional bottom view, in enlarged scale, taken along the line 5—5 of FIG. 1.

DESCRIPTION OF THE PREFERRED EMBODIMENT

The vanity slat apparatus of the present invention includes, generally, a plurality of elongated juxtaposed slats 14, preferably constructed of corrugated PVC and of a length and width sufficient to be threaded through and closely interfit the interstices 15 formed in a chain link fence 17. The slats 14 are constructed of a width to be received snugly within the horizontal width of such interstices 15 and are formed integrally with bosses 19 and 21 (FIG. 3) to form therebetween respective grooves 23 into which the lengths of the fence wire 25 may be snapped to hold the slats firmly in position in the fence.

Chain link fences have generally found great utility due to the relative economy of manufacture and ease of installation. However, in certain instances, it is desirable to cover lengths of such chain link fences with a screen of opaque or translucent material to thus block the viewer's vision of adjacent areas. While numerous different arrangements have been proposed for use with chain link fence to achieve the desired results, such devices typically require that the slats be constructed with relatively expensive attachment devices and often require the attachment of an additional retaining strip, rod or other fastener element to hold the slats in position on the chain link fence. The apparatus of the present invention incorporates relatively inexpensive plastic construction which affords some flexibility in both longitudinal and lateral directions for accommodating irregularities in the size of the fence interstices and which can be conveniently and rapidly snapped into position without the necessity of securement of separate fastening devices.

Referring to FIG. 5, the slats 14 of the present invention are conveniently formed of thin-walled PVC having lateral flexibility and are configured with a pair of springy side-by-side ribs 31 and 33 separated by an undulation 35 and terminating in its opposite edges in respective flared flanges 37 and 39. This configuration provides an arrangement whereby the walls of such ribs and 31 and 33 and undulation 35 may be flexed to collapse laterally inwardly somewhat to facilitate weaving of the slats into the interstices 15. The lateral flanges 37 and 39, when coupled with the characteristic of the ribs 31 and 33 to flex in the lateral direction, thus provide substantial flexibility in lateral width for installation purposes while maintaining a certain bias tending to expand the width of such slats to the constraint afforded by the wire defining such interstices and tending to facilitate in frictionally retaining such slats in position.

Referring to FIG. 5, the undulation 35 is formed with the integral bosses 19 and 21 located near the top ends of the respective slats 14. The bosses 19 and 21 are formed by merely pressing the wall of such undulation 35 out during the manufacturing process to thus afford the bulbous projections 19 and 21 which present a limited amount of flexibility to accommodate snapping of the fence wire 25 in position within the groove 23 formed between such bosses.

It will be appreciated by those skilled in the art that the slats 14 of the present invention may be fabricated in a rather inexpensive operation and may during the manufacturing process be cut to the desired length. The slats may then be conveniently stacked for packaging to be shipped to the retail outlets.

A homeowner or do-it-yourselfer desiring to provide a blind for a run of chain link fence may conveniently determine the number of slats required for the project and purchase those slats packaged and ready to install. Installation may be conveniently achieved by merely withdrawing the slats from the packaging and threading them downwardly through the interstices 15 of the chain link fence 17 to such a degree that the diagonal wire 25 corresponding with the height at which the slat is to be maintained registers with the groove 23 to thereby be snapped into position retaining the slat against further longitudinal travel. It will be appreciated that during this installation process, the humps of the respective ribs 31 and 33 may be flexed downwardly to some degree and the lateral edges of the flanges 37 and 39 flexed inwardly to the degree required to accommodate a certain amount of irregularity in the interstices 15.

It will be appreciated that the positioning of the slats may be alternated from one to the next to thus face the latching bosses 19 and 21 alternately in the opposite direction to facilitate registration with the desired length of chain link fence to hold the slats at their desired elevation.

Once in position, the slats 14 will be maintained securely in place to conveniently and effectively provide a long and maintenance free service life blocking unrestricted view through the chain link fence.

From the foregoing, it will be apparent that the vanity slat of the present invention is relatively economical to manufacture, economical and convenient to install and serves to provide a long and trouble free life.

What is claimed is:

1. Vanity slat apparatus for installation in the interstices formed by lengths of wire included in a chain link fence and comprising;

a plurality of elongated corrugated slats, each formed with at least one longitudinal rib, sized and configured to be woven through said interstices to be dispersed in spaced apart side by side relation, said slats each being formed with at least a pair of raised retaining bosses defining cams projecting from said rib to form therebetween a groove whereby said slats may be interwoven in said interstices to cause one of said lengths of wire to ride up over one of said cams to snap into said groove to be held captive to said fence.

2. Vanity slat apparatus as set forth in claim 1 wherein:

said bosses are semi-cylindrically shaped in longitudinal cross section.

3. Vanity slat apparatus as set forth in claim 1 wherein:

said bosses are sufficiently rigid to, during installation of said slats in said fence, project from the surface of said rib and resist collapse by said lengths of wire.

4. Vanity slat apparatus as set forth in claim 1 wherein:

said slat and boss are formed from a continuous unbroken sheet.

5. Vanity slat apparatus according to claim 1 wherein:

said slats are constructed from corrugated plastic sheet.

6. Vanity slat apparatus according to claim 5 wherein:

said slats are formed by a pair of parallel configuration ribs.

7. Vanity slat apparatus according to claim 5 wherein:

said slats are formed by a pair of parallel corrugation ribs separated by an intermediate reverse rib defining an undulation, said bosses being formed on said reverse rib.

8. Vanity slat apparatus according to claim 7 wherein:

said slats are further formed on the opposite sides of said pair of ribs with laterally projecting resilient flanges.

* * * * *